US009089755B2

(12) United States Patent
Holland

(10) Patent No.: US 9,089,755 B2
(45) Date of Patent: Jul. 28, 2015

(54) GOLF PRACTICE MAT

(75) Inventor: Allen Holland, Sheffield (GB)

(73) Assignee: Pro Performance Sports, L.L.C., Carlsbad, CA (US)

( * ) Notice: Subject to any disclaimer, the term of this patent is extended or adjusted under 35 U.S.C. 154(b) by 522 days.

(21) Appl. No.: 13/456,809

(22) Filed: Apr. 26, 2012

(65) Prior Publication Data

US 2013/0288814 A1 Oct. 31, 2013

(51) Int. Cl.
*A63B 69/36* (2006.01)

(52) U.S. Cl.
CPC ..... *A63B 69/3623* (2013.01); *A63B 69/3661* (2013.01)

(58) Field of Classification Search
USPC ..... 473/150, 278
See application file for complete search history.

(56) References Cited

U.S. PATENT DOCUMENTS

| | | | | | |
|---|---|---|---|---|---|
| 4,130,283 | A * | 12/1978 | Lindquist | 473/262 |
| 4,311,312 | A * | 1/1982 | O'Brien | 473/218 |
| 4,387,896 | A * | 6/1983 | O'Brien | 473/218 |
| 5,026,580 | A * | 6/1991 | Hammon | 428/17 |
| 5,340,109 | A * | 8/1994 | Miller | 473/262 |
| 5,692,967 | A * | 12/1997 | Guyer | 473/262 |
| 5,888,147 | A * | 3/1999 | Luedtke | 473/278 |
| 5,908,673 | A * | 6/1999 | Muhlberger | 428/17 |
| 6,156,396 | A | 12/2000 | Florian | |
| 6,276,031 | B1 * | 8/2001 | Haiduk | 24/298 |
| 6,994,634 | B1 | 2/2006 | McFarlin et al. | |
| 7,104,900 | B1 * | 9/2006 | Finley | 473/278 |
| 7,384,346 | B2 | 6/2008 | McFarlin et al. | |
| 2007/0155526 | A1 | 7/2007 | McFarlin et al. | |
| 2012/0178546 | A1 * | 7/2012 | Park | 473/278 |

OTHER PUBLICATIONS

SKLZ Glide Pad, http://shop.sklz.com/golf/practice/icat/golf-practice, Aug. 2014.*

Korean Intellectual Property Office, International Search Report and Written Opinion mailed Aug. 26, 2013 in International Application No. PCT/US2013/038183.

* cited by examiner

*Primary Examiner* — William Pierce

(74) *Attorney, Agent, or Firm* — Squire Patton Boggs (US) LLP

(57) ABSTRACT

A golf mat includes a frame having a central channel between left and right side shoulders. A hitting pad, such as an artificial turf pad, is slidable within or on the central channel. At least one elastic element, such as a rubber cord, extends laterally across the channel, and with the elastic element attached directly or indirectly to the artificial turf pad. Impact of the golf club head on the pad causes the pad to slide forward, absorbing impact forces and providing a feel to the golfer closer to hitting off of real grass. The elastic element decelerates the pad, and returns to the pad to its original position after the impact. The elastic element may be an elastic cord having plugged or knotted ends secured between inner and outer walls of the side shoulders of the frame.

18 Claims, 6 Drawing Sheets

GOLF PRACTICE MAT

BACKGROUND OF THE INVENTION

Golf can be a challenging sport, even for professionals. For most people, acquiring a high level of skill and consistency in golf requires regular practice, far beyond the time available for actually playing the game on a golf course. Various golf practice devices have been created to accommodate golfers' need to practice, including golf mats. A golf mat typically includes a piece of artificial turf in a frame or holder.

Providing a golf mat that simulates hitting off of real grass presents engineering challenges. Hitting a golf ball with an iron, if done correctly, requires the club head to impact the golf ball on the down swing, just before the club head passes through the lowest point of the arc of the swing. During real play on a golf course, the club head should typically swing through and scoop out a divot or small clump of turf. Golf mats however are used repeatedly, with the club head impacting the same mat with every swing. For this and other reasons, providing a golf mat that allows for taking a divot out of the mat is not viable. Consequently, golf mats have tried to simulate the feel of the taking a divot. Golf mat designs have been proposed that allow the artificial turf piece to shift under impact, to simulate hitting off of real grass. Although allowing the artificial turf piece to shift is useful, disadvantages remain with these types of designs.

SUMMARY OF THE INVENTION

A new golf mat has now been invented. In one aspect, this new golf mat includes a frame having a central channel between left and right side shoulders. A hitting pad, such as an artificial turf pad, is slidable within or on the central channel. At least one elastic element, such as a rubber cord, extends laterally across the channel, and with the elastic element attached directly or indirectly to the artificial turf pad. Impact of the golf club head on the pad causes the pad to slide forward, absorbing impact forces and providing a feel to the golfer closer to hitting off of real grass. The elastic element decelerates the pad, and returns to the pad to its original position after the impact. The elastic element may be attached to the shoulders. The elastic element may be an elastic cord having plugged or knotted ends secured between inner and outer walls of the side shoulders of the frame.

Other and further objects and advantages will become apparent from the following detailed description and drawings, which are provide to show examples of how the invention may be designed and used, and which are not intended to be statements of the limits of the scope of the invention. The invention resides as well in sub-combinations of the elements described, and also in methods of using the golf mat described.

BRIEF DESCRIPTION OF THE DRAWINGS

In the drawings, the same element number indicates the same element in each of the views.

DETAILED DESCRIPTION OF THE DRAWINGS

Figure 1:
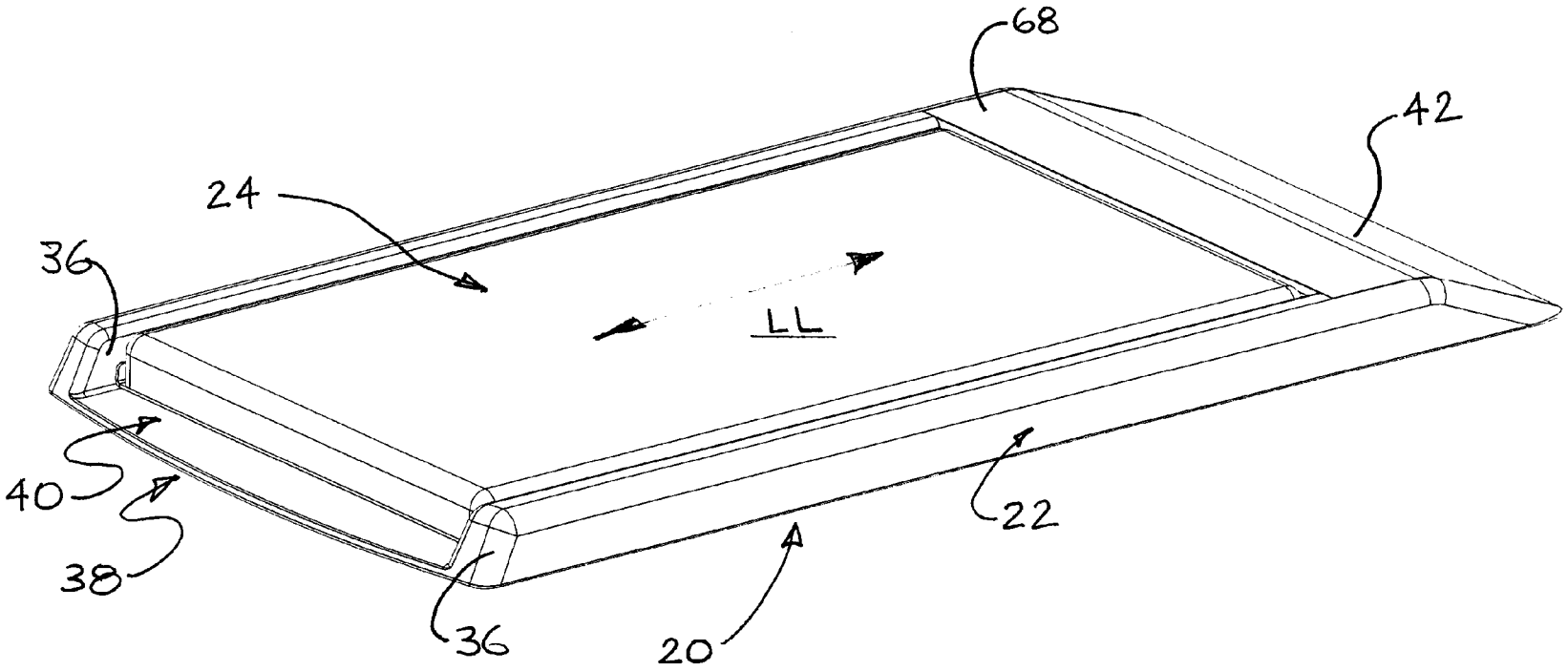
FIG. 1 is a front and top perspective view of a new golf mat.
Figure 2:
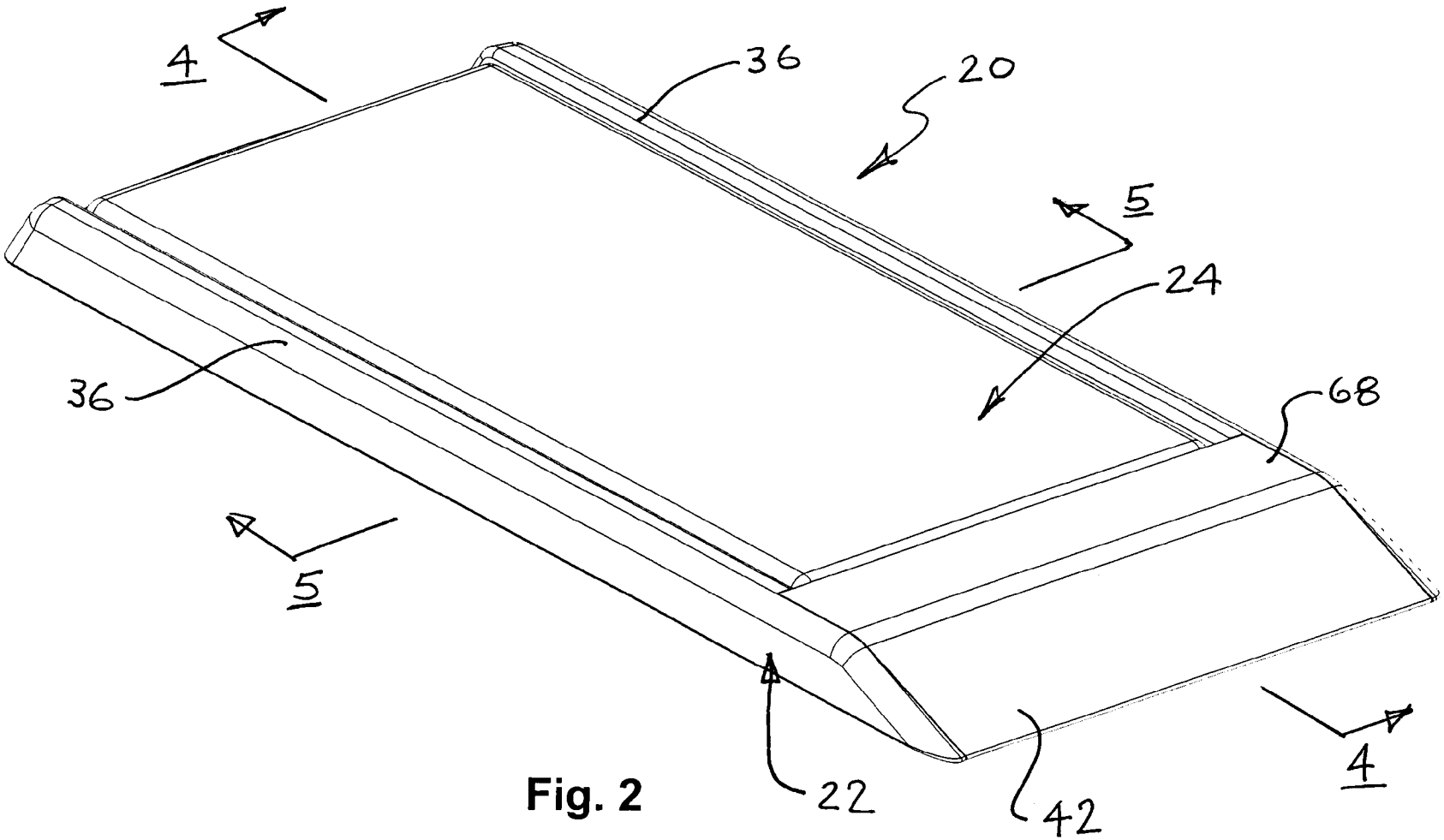
FIG. 2 is a back and top perspective view of the golf mat shown in FIG. 1.

Turning now in detail to the drawings, as shown in FIGS. 1 and 2, a golf mat 20 has a floor frame 22. The floor frame 22 has a flat bottom surface that rests on the floor or ground. The frame 22 has raised side shoulders or rails 36 on opposite sides of a channel 38. The front end 40 of the fame 22 is open, while the back end of the frame has a ramp 42 extending up at an acute angle from the bottom of the fame to a flat raised landing 68. The frame 22 may be formed of various materials such as metal, wood or plastic, and typically may be provided as a single plastic molded unit. The frame can take various shapes, although a rectangular frame is shown, having a length of about 1.5 to 2.5 greater than the width. For example, the frame may be 20-28 inches long and 10 to 14 inches wide. In a typical design, the frame may be 24 inches long and 12 inches wide.

Figure 3:
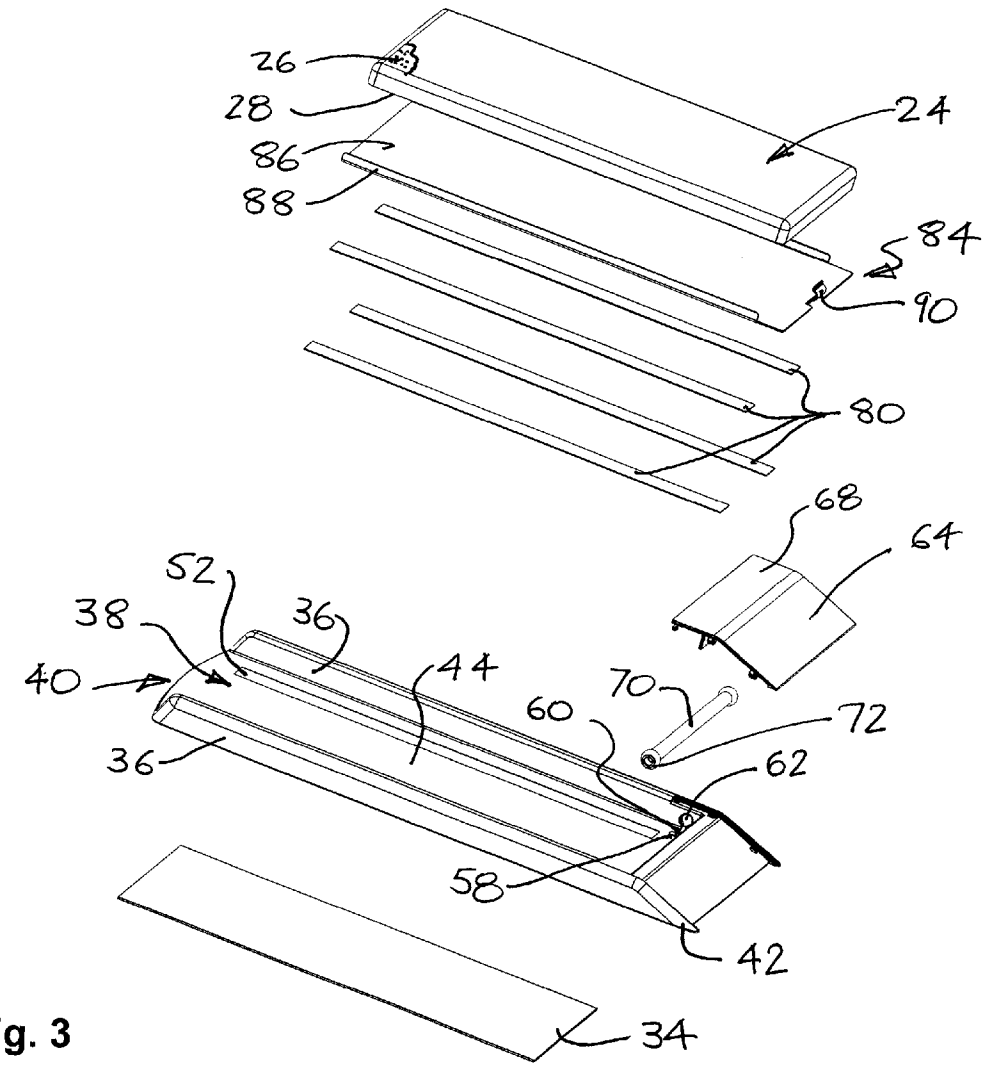
FIG. 3 is an exploded perspective view of the golf mat shown in FIGS. 1 and 2.
Figure 4:
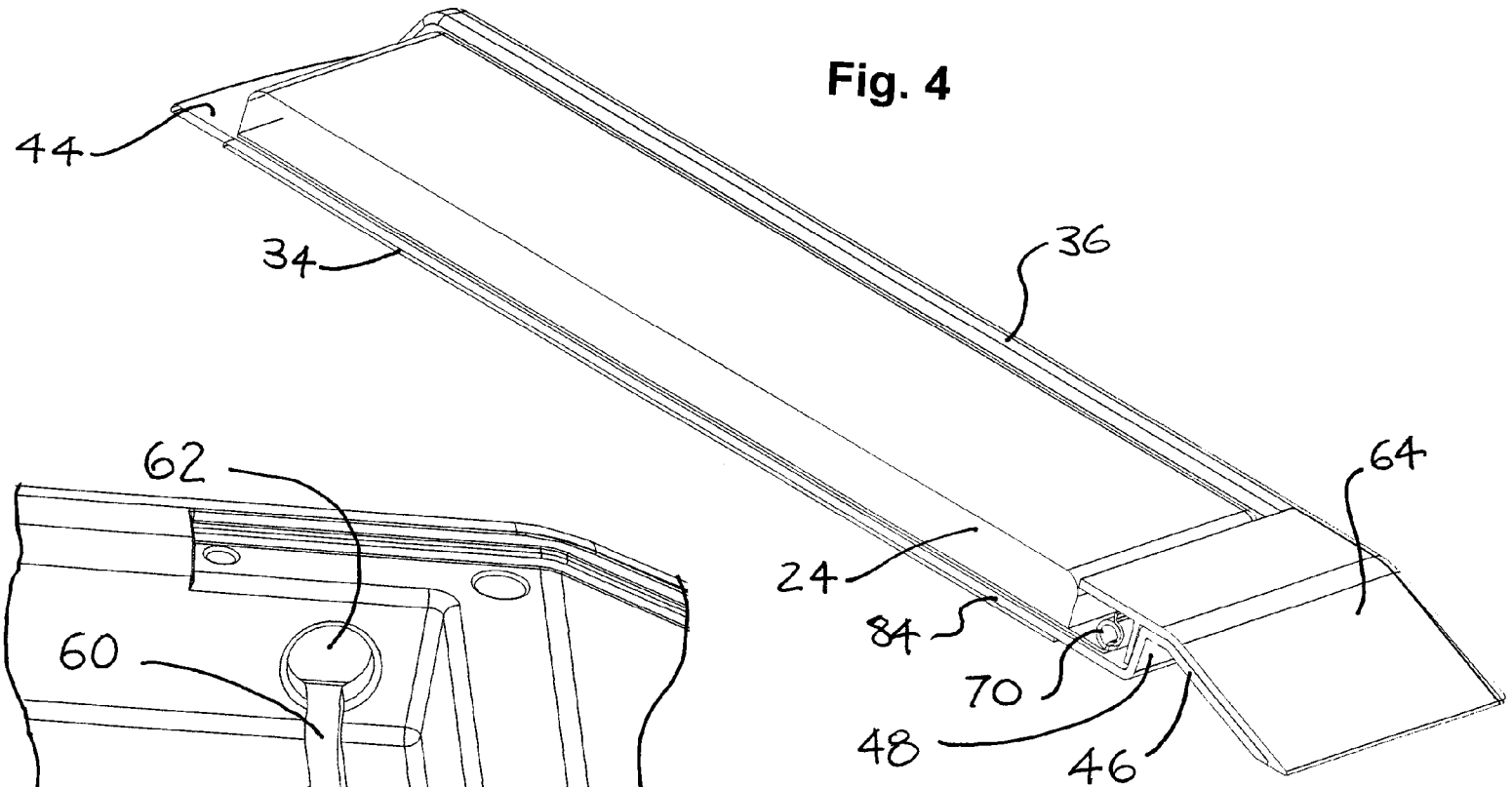
FIG. 4 is a section view taken along line 4-4 of FIG. 2.

Turning now to FIG. 3, the side shoulders 36 are joined to and extend vertically up from a frame floor 44, with the shoulders 36 and the floor 44 forming the three-sided channel 38. As shown in FIGS. 1-3, a hitting pad 24 is positioned within the frame 22, with the top surface of the pad 24 extending up above the shoulders 36. As shown in FIG. 1, the hitting pad 24 may be slightly shorter than the channel 38 in the frame 22, so that a short segment of the front end of the floor 44, e.g., 1-2 inches, extends forward of the pad 24.

Typically the pad 24 may be a section of synthetic grass or turf. The synthetic grass generally is provided as individual plastic blades or fibers 26 attached to, or molded integral with, a base sheet 28, as shown in FIG. 3.

An elastic element 70 extends across the frame 22, adjacent to the back end of the channel 38. The elastic element 70 may be a rubber band or cord. One or more individual elastic elements 70 may be used. In the example shown, the elastic element is a hollow rubber cord having end plugs 72. The ends of the cord 70 are attached to the frame. The cord 70 is directly or indirectly attached to the pad 24. The cord is oriented so that extends laterally across the width of the channel 38. The cord may therefore also be oriented perpendicular to a longitudinal axis LL of the frame 22 shown in FIG. 1.

In a basic form, the invention may include the pad 24 in or on the frame 22, with the cord attached to the pad near a back end of the pad. In use, the impact of the golf club head onto the pad 24 causes the pad 24 to slide forward in the frame 22 in a direction parallel to the longitudinal axis LL. The cord 70 exerts an elastic or spring return force on the pad 70, which is typically roughly linearly proportional to the forward displacement of the pad. The cord 70 consequently acts to decelerate the forward movement of the pad, and then also pull the pad back to its original position, after the club head impact.

FIGS. 3-6 show additional elements for providing a still further improved design. As shown in FIG. 3, the pad 24 may be attached to a supporting element such as a slide tray 84, having side walls 88 extending up at opposite sides of a floor section 86, and a rear hook or pin 90. The hook 90 is engaged around the cord 70, with the hook typically at or near a longitudinal centerline of the frame 22, and the hook engaging a center position of the cord 70. To better facilitate sliding movement of the pad 24 relative to the frame 22, low friction slide strips 80, or an equivalent slide plate, may be positioned between the bottom surface of the slide tray 84 and the floor 44 of the frame 22.

As shown in FIG. 3, a separate cover 64 may be attached at the back end of the frame 22, in this case using tabs or fasteners 66. The cover 64 as shown has an angled section that fits on top of or forms the ramp 46 at the back end of the frame 22, and a flat section that fits on top of or forms the landing 68 that separates the ramp 46 from the channel 38. The cover 64 may be shock absorbing material, such as soft PVC, to reduce damage to the mat and shock impulses to the user's hands, if the club head hits the cover 64. The strips described above may optionally provided as plates, and vice versa.

Figure 5:
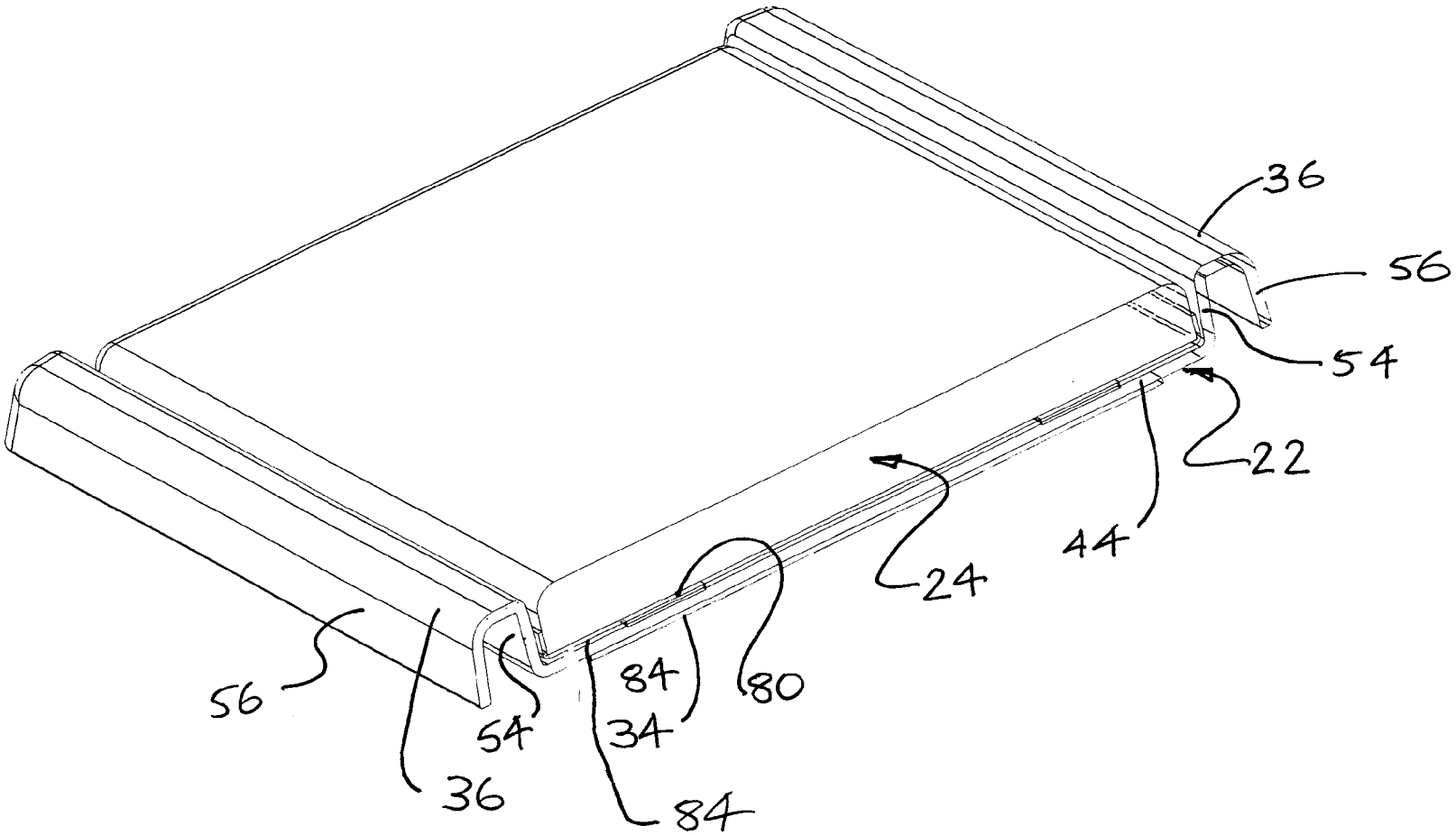
FIG. 5 is a section view taken along line 5-5 of FIG. 2.

As shown in FIG. 5, each side shoulder 36 may have an inner wall 54, a top end, and an outer wall 56, with the shoulder 36 generally in the form of an inverted "U". The inner wall 54 may be joined to the floor 44. The lower edge of the outer wall 56 may be co-planer with the bottom surface of the floor 44. As also shown in FIG. 5, a friction or gripping sheet or strips 34 may be attached onto the bottom surface of the frame 22, to reduce movement of the frame 22 on the supporting indoor or outdoor floor or ground surface.

Figure 3A:
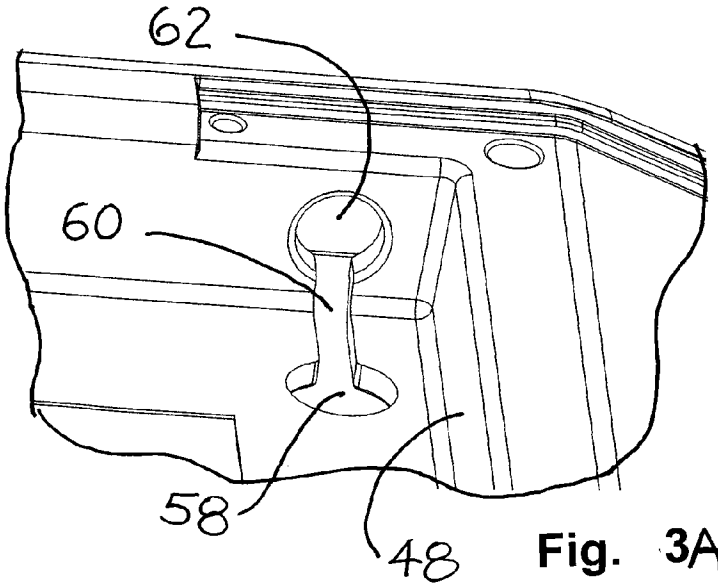
FIG. 3A is an enlarged view of a detail of FIG. 3.
Figure 6:
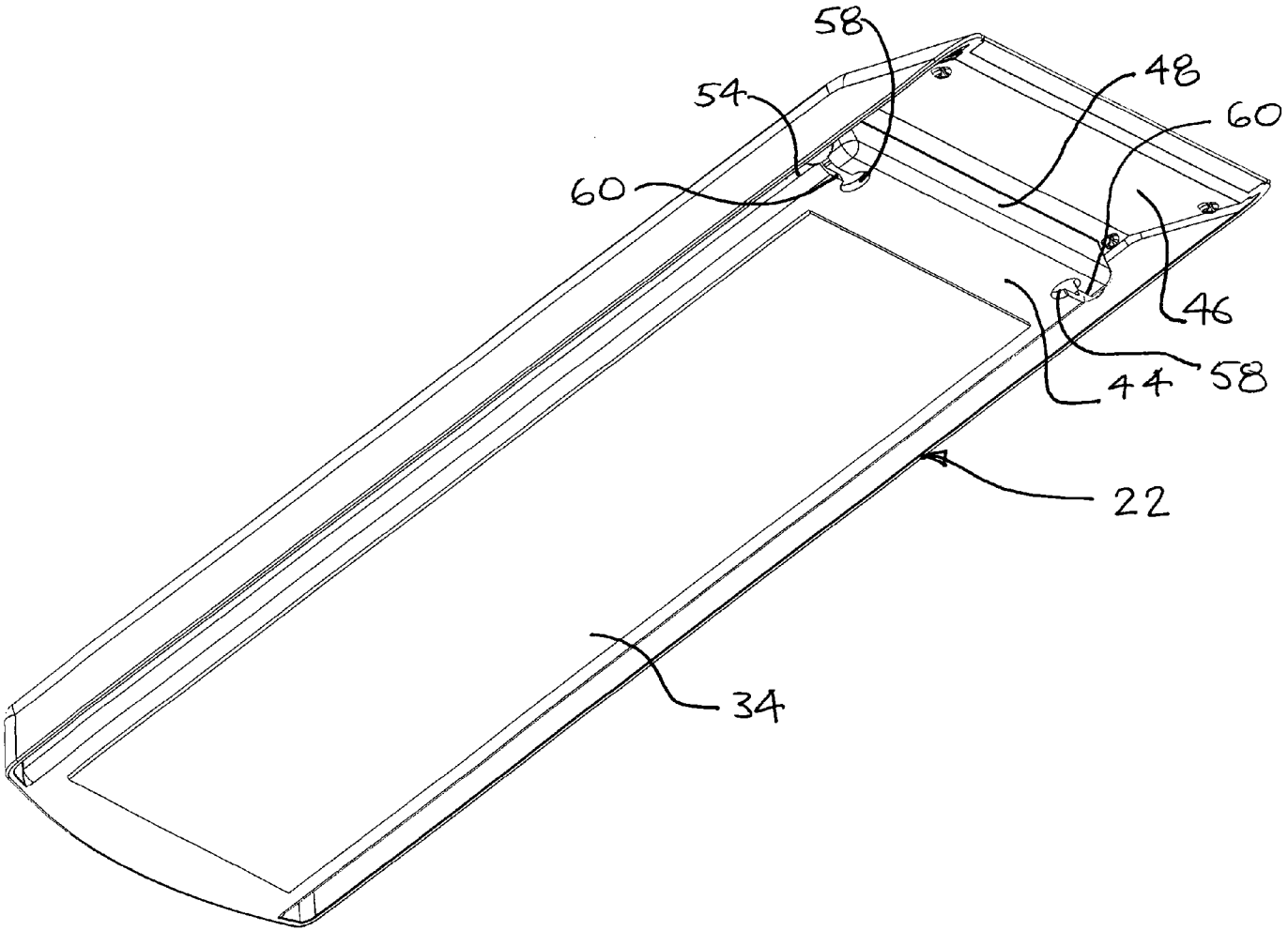
FIG. 6 is a bottom perspective view of the golf mat shown in FIGS. 1-3.

FIGS. 3A and 6 illustrate a design that allows the cord 70 to be quickly and easily installed or removed from the mat 20, to allow the user to replace the cord 70 as needed. As shown in FIG. 6, bottom holes 58 are provided through the floor 44 near the back end of the channel 38, adjacent to the vertical back channel wall 48. As shown in FIG. 3A, a slot 60 in the floor 44 extends laterally outward into the inner wall 54 of the side shoulder 36 on each side of the frame 22, with the slot connecting into a side hole 62 in the inner wall 54.

The elastic element 70 may be provided as a cord with end plugs or knots 72 at the ends of the cord. The terms plug, knot and protrusion are used here interchangeably. In this case, the bottom holes 58 have a diameter large enough to allow the plugged or knotted end of the cord to pass through. The diameter of the side holes is small enough to prevent the plugged or knotted ends from passing through the inner wall 54.

With the pad temporarily lifted out of and removed from the frame 22, and with the slide tray, if present, also removed, the ends of the cord are threaded down through the bottom holes 58. The ends are then moved outward through the slots 60, with the plug or knot positioned at the side holes. The body of the cord is pulled up through the slots, so that the cord extends in a straight line across the channel 38. Since the plug or knot cannot pass through the side holes 62, the cord is secured in place extending laterally across the channel, between the left and right side inner walls 54, and with the plug or knot between the inner wall 54 and the outer wall 56.

Installing the cord 70 as described above may optionally pre-tension the cord by stretching the cord. The pad and the slide tray 84, if used, are placed back onto the frame 22. The cord 70 is pulled up and forward and placed over the hook 90 or other attachment point. The cover 64 is replaced and conceals the cord 70.

In use, the golfer swings a club to hit a ball off of the pad 24, as in actual outdoor golf course play. If the club head strikes only the ball, without significant contact between the club head and pad 24, then the pad will remain stationary. On the other hand, if the club head makes significant contact with the pad 24, the fibers of the pad will initially absorb some of the impact. The pad 24 will also slide forward, further absorbing the impact of the club head on the pad 24. The forward movement of the pad 24 reduces the impact reaction shock and vibration acting on the golfer's hands and arms. The golfer accordingly gets a feeling more similar to hitting off of real grass, where the grass and soil absorb impact forces. The forward movement of the pad may also tend to reduce inadvertent deflection or bouncing of the club head, allowing for a more accurate hit. After the impact of the club head, the cord 70 pulls the displaced pad back to its original position. The golf mat 20 is then ready for the next swing by the golfer.

Thus, a novel golf mat has been shown and described. Various changes and substitutions may of course be made without departing from the spirit and scope of the invention. The invention, therefore, should not be limited except by the following claims, and their equivalents.

The invention claimed is:

1. A golf mat, comprising:

a frame having a central channel between left and right side shoulders, wherein the left and right side shoulders extend substantially vertically upward relative to a frame floor;

a slide tray slidable relative to the frame along a first axis within the central channel;

a simulated grass pad on the tray;

at least one elastic element extending laterally across the central channel substantially perpendicular to the first axis with the elastic element attached to the slide tray between the left and right side shoulders of the frame, wherein the elastic element has a left end secured to the left side shoulder of the frame and a right end secured to the right side shoulder of the frame, the elastic element being shorter than the width of the channel such that it must be streteched to be installed with the left end secured to the left side shoulder and the right end secured to the right side shoulder.

2. The golf mat of claim 1 with the elastic element having the left end secured into the left side shoulder and having thight end secured into the right side shoulder.

3. The golf mat of claim 1 with the elastic element comprising a single cord having a length at least 10 times greater than the diameter of the cord, and with the cord extending in a substantially straight line across the channel.

4. The golf mat of claim 2 with the elastic element comprising an elastic cord having a left plug in the left end and a right plug in the right end, and with the left and right side shoulders each having an inner wall and an outer wall, and with the left plug between the inner wall and the outer wall of the left side shoulder, and the right plug between the inner wall and the outer wall of the right side shoulder.

5. The golf mat of claim 2 further comprising:

a frame floor between the left and right side shoulders;

a left floor hole in the floor adjacent to the left side shoulder, a left side hole in the inner wall of the left side shoulder, and a slot connecting the left floor hole to the left side hole;

a right floor hole in the floor adjacent to the right side shoulder, a right side hole in the inner wall of the right side shoulder, and a slot connecting the right floor hole to the right side hole;

with the left and right side holes having diameters less than the left and right plugs, respectively; and with the left and right floor holes having diameters greater than the left and right plugs, respectively.

6. The golf mat of claim 1 with the elastic element attached to a back end of the slide tray.

7. The golf mat of claim 6 further comprising a hook at the back end of the slide tray and with the elastic element attached to the slide tray by looping the elastic element over the hook.

8. The golf mat of claim 1 further comprising a gripping surface on a bottom of the frame.

9. The golf mat of claim 1 further including a ramp at a back end of the frame and a flat elevated landing between the ramp and the channel.

10. The golf mat of claim 1 further comprising a vertical wall at a back end of the channel, and with the elastic element adjacent to the vertical back wall.

11. The golf mat of claim 5 with the elastic element removable from the frame by moving the plugs from the side holes to the bottom holes.

12. The golf mat of claim 1 with the elastic element comprising a single elastic tube or band.

13. The golf mat of claim 1 with the pad having a top surface extending above the left and right side shoulders.

14. A golf mat, comprising:

a floor frame having a first shoulder and a second shoulder, and a central channel having a floor between the first and second shoulders;

a slide tray on the floor frame, the slide tray being slidable relative to the floor frame;

a simulated grass pad attached to the slide tray;

an elastic cord extending laterally across the floor frame in the central channel, adjacent to a back end of the floor frame, from the first shoulder to the second shoulder of the floor frame, with the elastic cord releasably attached to the slide tray between the first shoulder ans the second shoulder, wherein the elastic cord has a first end secured to the first shoulder and a second end secured to the second shoulder, the elastic cord being shorter than the width of the channel such that it must be stretched to be installed with the first end secured to the first shoulder and the second end secured to the second shoulder; and a ramp cover plate extending from the back end of the floor frame, with the ramp cover plate covering the elastic cord and having a ramp surface extending up at an acute angle from a plane of the floor to the left and right side shoulders.

15. The golf mat of claim 14 with the grass pad fixed in place on the slide tray.

16. A golf mat, comprising:

a floor frame having a lefdt slide shoulder and a right side shoulder and a floor;

a slide tray on the floor frame, with the slide tray slidable in a first direction relative to the floor frame;

a simulated grass pad fixed in place on the slide tray;

an elastic cord adjacent to a back end of the floor frame, with the elastic cord releasably attached to the slide tray between the left side shoulder and the right side shoulder, and with the elastic cord extending across the floor frame in a second direction perpendicular to the first direction;

a left protrusion at a left end of the elastic cord, and a right protrusion at a right end of the elastic cord;

a left floor hole in the floor adjacent to the left side shoulder, a left side hole in an inner wall of the left side shoulder, and a slot connecting the left floor hole to the left side hole;

a right floor hole in the floor adjacent to the right side shoulder, a right side hole in an inner wall of the right side shoulder, and a slot connecting the right floor hole to the right side hole;

with the left and right side holes having diameters less than the left and right protrusions, respectively; and with the left and right floor holes having diameters greater than the left and right protrusions, respectively, wherein the left protrusion of the cord is configured to be secured to the left side hole of the left side shoulder and the right protrusion of the cord is configured to be secured to the right side hole of the right side shoulder such that the cord extends in a substantially straight line across the floor frame in the second direction, the cord being shorter than the width of the floor such that it must be stretched to be installed with the left protrusion secured to the left side hole and the right protrusion secured to the right side hole.

17. The golf mat of claim 16 with the protrusions comprising a plug or a knot.

18. The golf mat of claim 1 with the elastic element extending entirely across the central channel.

* * * * *